US010226861B2

(12) United States Patent
Lee

(10) Patent No.: US 10,226,861 B2
(45) Date of Patent: Mar. 12, 2019

(54) HAND TOOL

(71) Applicant: Chih-Ming Lee, Taichung (TW)

(72) Inventor: Chih-Ming Lee, Taichung (TW)

( * ) Notice: Subject to any disclaimer, the term of this patent is extended or adjusted under 35 U.S.C. 154(b) by 482 days.

(21) Appl. No.: 15/005,000

(22) Filed: Jan. 24, 2016

(65) Prior Publication Data

US 2017/0210000 A1 Jul. 27, 2017

(51) Int. Cl.
*B25G 1/06* (2006.01)
*B25B 13/46* (2006.01)

(52) U.S. Cl.
CPC ..... *B25G 1/063* (2013.01); *B25B 13/461* (2013.01)

(58) Field of Classification Search
CPC ..... B25G 1/063; B25G 1/066
USPC ..... 81/177.8, 177.7, 177.9
See application file for complete search history.

(56) References Cited

U.S. PATENT DOCUMENTS 4,901,608 A * 2/1990 Shieh ..... B25B 13/461 81/177.8
6,000,299 A * 12/1999 Cole ..... B25B 13/461 81/177.7
6,928,904 B2 * 8/2005 Hsien ..... B25B 13/461 81/177.8
7,156,003 B2 * 1/2007 Cole ..... B25G 1/063 403/97
7,197,965 B1 * 4/2007 Anderson ..... B25B 13/481 81/177.9
7,373,861 B2 * 5/2008 Hsieh ..... B25G 1/063 403/93
8,156,845 B2 * 4/2012 Lin ..... B25B 13/463 81/177.8
2006/0137491 A1 * 6/2006 Chen ..... B25B 13/461 81/58
2010/0186557 A1 * 7/2010 Hsieh ..... B25B 23/0028 81/177.8

* cited by examiner

*Primary Examiner* — David B Thomas

(57) ABSTRACT

A hand tool includes a first body, a locking member and a second body. The first body has a function end, a pivotal hole, a first toothed portion, a first groove, a second groove and a first restriction groove. The locking member has a second toothed portion, a second restriction groove, a first connection portion, a restriction member, an engaging member and a resilient member. The second body has a third connection portion connected to the first connection portion to connect the first and second bodies. When the locking member moves to a first position, the engaging member is engaged with the first groove. The first toothed portion is engaged with the second toothed portion. When the locking member moves to a second position, the engaging member is engaged with the second groove. The first toothed portion is disengaged from the second toothed portion.

9 Claims, 10 Drawing Sheets

C-C

C-C

C-C

HAND TOOL

BACKGROUND OF THE INVENTION

1. Fields of the Invention

The present invention relates to a hand tool, and more particularly, to a hand tool with a first body and a second body which is pivotably connected to the first body.

2. Descriptions of Related Art

The conventional hand tool disclosed in U.S. Pat. No. 5,419,221 comprises a first body with a first toothed portion having teeth defined therein, and a second body with second toothed portion which has teeth defined therein. A first locking member having a pivotal hole and a third toothed portion which is engaged with the second toothed portion. A groove is defined beneath the third toothed portion, and a fourth toothed portion formed below the groove. The fourth toothed portion is engaged with the first toothed portion. An engaging member is located on the third toothed portion and contacts the top of the second body. The first locking member has a threaded hole located below the first locking member. A second locking member is threadedly connected to the threaded hole of the first locking member so as to axially connect the first and second bodies 13, 17. When the user presses the first locking member, the pivotal hole is located corresponding to the second toothed portion, and the third toothed portion is located corresponding the first toothed portion. The user can rotate the second body an angle relative to the first body, however, the fourth toothed portion is exposed beyond the first body 13, and this does meet aesthetic purpose. Besides, the positioning feature of the hand tool is not stable.

The present invention intends to provide a hand tool which improves the shortcomings mentioned above.

SUMMARY OF THE INVENTION

The present invention relates to a hand tool and comprises a first body having a function end and a first pivotal portion which has a pivotal hole. A first toothed portion is defined in the inside of the pivotal hole and located at the lower portion of the pivotal hole. First and second grooves are respectively defined in the inside of the pivotal hole. A first restriction groove is defined in the pivotal hole and located above the second groove. A first diameter is defined by tips of teeth of the first toothed portion. The first toothed portion, the second groove and the first restriction groove are located from the top to the bottom of the inside of the pivotal hole. A locking member extends through the pivotal hole and has a second toothed portion, and a reception hole is located at the lower portion of the outside thereof. The locking member has a second restriction groove defined in the outside thereof so as to define a first contact portion and a second contact portion respectively located on two ends of the second groove. The second groove is located corresponding to the first restriction groove. A non-circular first connection portion is formed on the upper portion of the outside of the locking member. The reception hole is located between the second toothed portion and the second restriction groove.

A restriction member is a C-shaped member and engaged between the first and second restriction grooves. An engaging member and a resilient member are located in the reception hole. The engaging member is biased outward by the resilient member. A second body has a third connection portion so as to be connected to the first connection portion.

When the locking member in the pivotal hole moves to a first position, the restriction member contacts the first contact portion. The engaging member is engaged with the first groove. The first toothed portion is engaged with the second toothed portion. When the locking member in the pivotal hole moves to a second position, the restriction member contacts the second contact portion. The engaging member is engaged with the second groove. The first toothed portion is disengaged from the second toothed portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
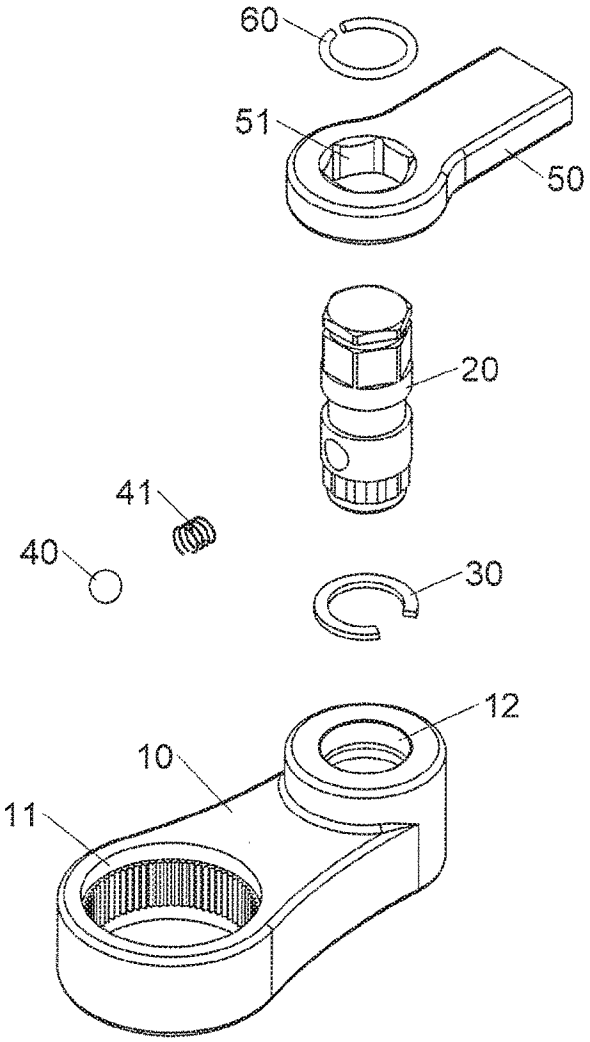
FIG. 1 is an exploded view of the hand tool of the present invention.
Figure 4:
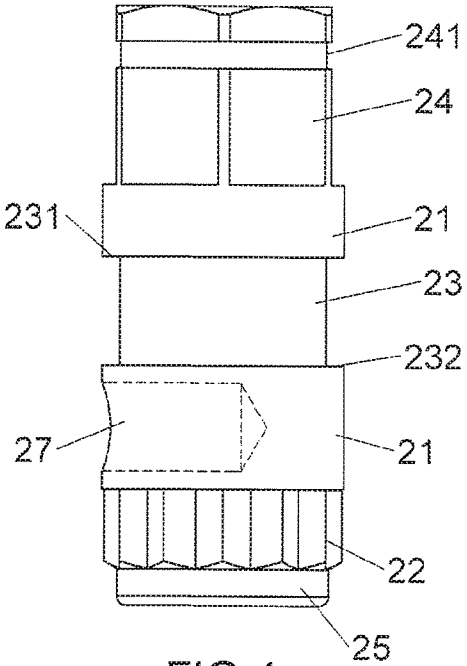
FIG. 4 is a side view of the locking member of the hand tool of the present invention.
Figure 2:
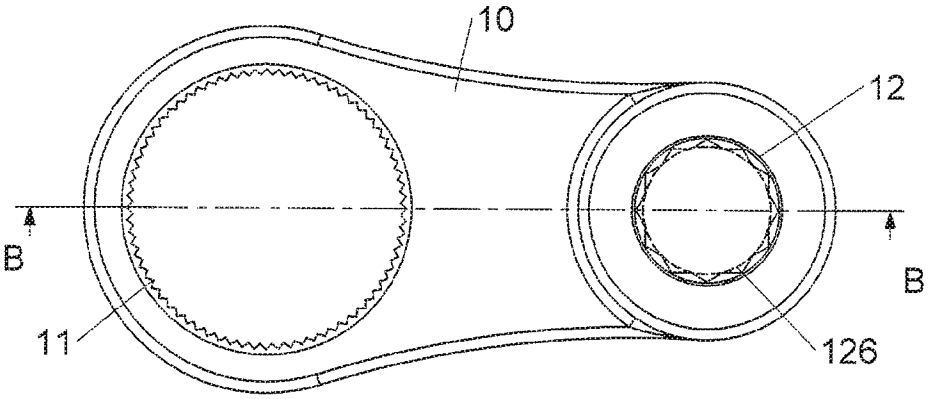
FIG. 2 is a top view of the first body of the hand tool of the present invention.
Figure 3:
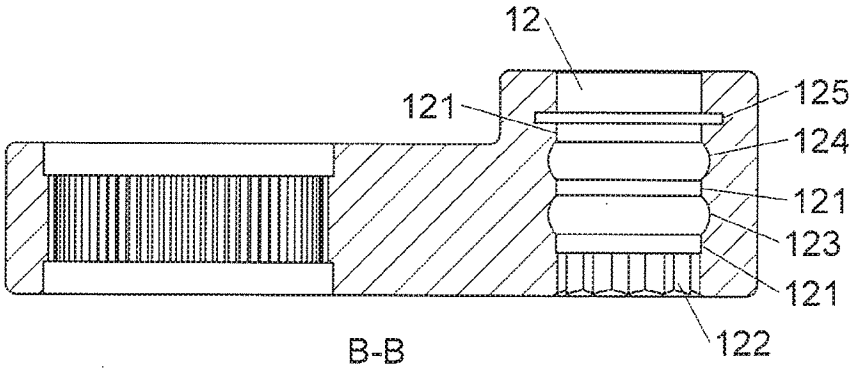
FIG. 3 is a cross sectional view, taken along line B-B in FIG. 2.
Figure 5:
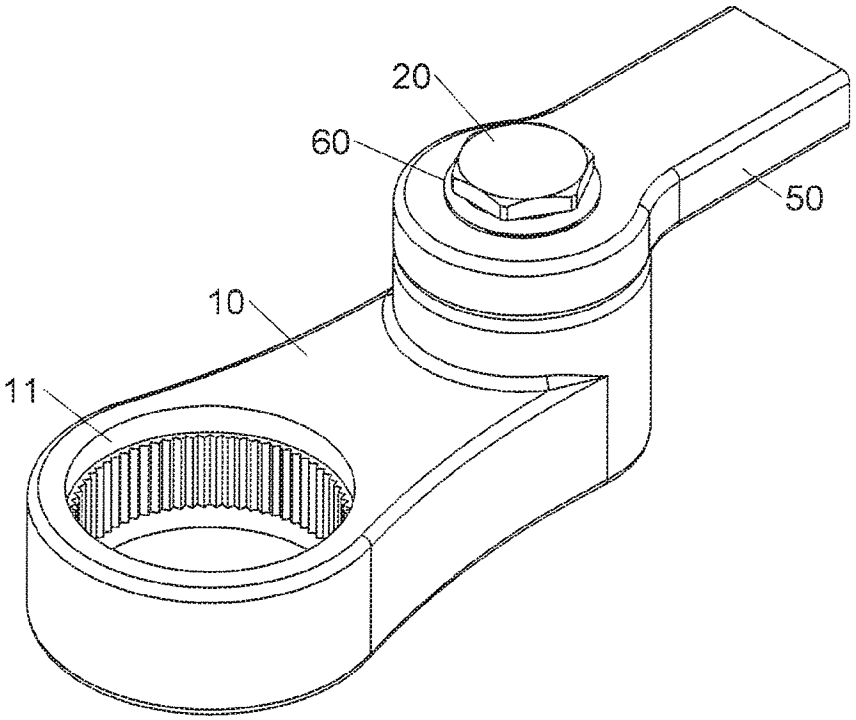
FIG. 5 is a perspective view to show the hand tool of the present invention.

Referring to FIGS. 1 to 5, the hand tool of the present invention comprises a first body 10 having a function end 11 and a first pivotal portion 12. The outer diameter of the function end 11 is larger than that of the first pivotal portion 12, and the function end 11 has teeth formed on the inside thereof so as to be cooperated with other hand tools. The first pivotal portion 12 has a pivotal hole 121 axially defined therethrough, and a first toothed portion 122 is circularly defined in the inside of the pivotal hole 121 and located at the lower portion of the pivotal hole 121. A first groove 123 and a second groove 124 are respectively defined in the inside of the pivotal hole 121 and circularly extending with respect to the central axe of the pivotal hole 121. A first restriction groove 125 is defined in the pivotal hole 121 and located above the second groove 124. A first diameter 126 is defined by tips of teeth of the first toothed portion 122. The first toothed portion 122, the second groove 124 and the first restriction groove 125 are located in sequence from the top to the bottom of the inside of the pivotal hole 121.

A locking member 20 extends through the pivotal hole 121. The locking member 20 has a second toothed portion 22 and a radial reception hole 27 located at a lower portion of an outside 21 thereof. The second toothed portion 22 is engaged with the first toothed portion 122. A third pivotal portion 25 extends from the underside of the second toothed portion 22. A diameter of the third pivotal portion 25 is smaller than that of the second toothed portion 22. The locking member 20 has a second restriction groove 23 defined in the outside 21 thereof so as to define a first contact portion 231 and a second contact portion 232 respectively located on two ends of the second groove 23. The second groove 23 is located corresponding to the first restriction groove 125. A non-circular first connection portion 24 is formed on the upper portion of the outside 21 of the locking member 20. The reception hole 27 is located between the second toothed portion 22 and the second restriction groove 23, such that the reception hole 27 is located corresponding to the first groove 123 or the second groove 124. In this embodiment, the first connection portion 24 is a hexagonal portion. The third pivotal portion 25 protrudes beyond the first body 10. The diameter of the third pivotal portion 25 is equal to or smaller than the first diameter 126.

A restriction member 30 is a C-shaped member and engaged between the first and second restriction grooves 125, 23. An engaging member 40 and a resilient member 41 are located in the reception hole 27, and the engaging member 40 is biased outward by the resilient member 41 so as to be engaged with the first groove 123 or the second groove 124.

When the locking member 20 in the pivotal hole 121 moves to a first position, the restriction member 30 contacts the first contact portion 231, the engaging member 40 is engaged with the first groove 123, and the first toothed portion 122 is engaged with the second toothed portion 22. When the locking member 20 in the pivotal hole 121 moves to a second position, the restriction member 30 contacts the second contact portion 232, the engaging member 40 is engaged with the second groove 124, and the first toothed portion 122 is disengaged from the second toothed portion 22.

A second body 50 has a third connection portion 51 which is a hexagonal recess so as to be connected to the first connection portion 24 to pivotably connect the first and second bodies 10, 50. The C-shaped connection member 60 has its inside engaged with the second connection portion 241, and the outside of the connection member 60 is engaged with the top of the second body 50 so that the second body 50 is connected to the locking member 20.

Figure 6:
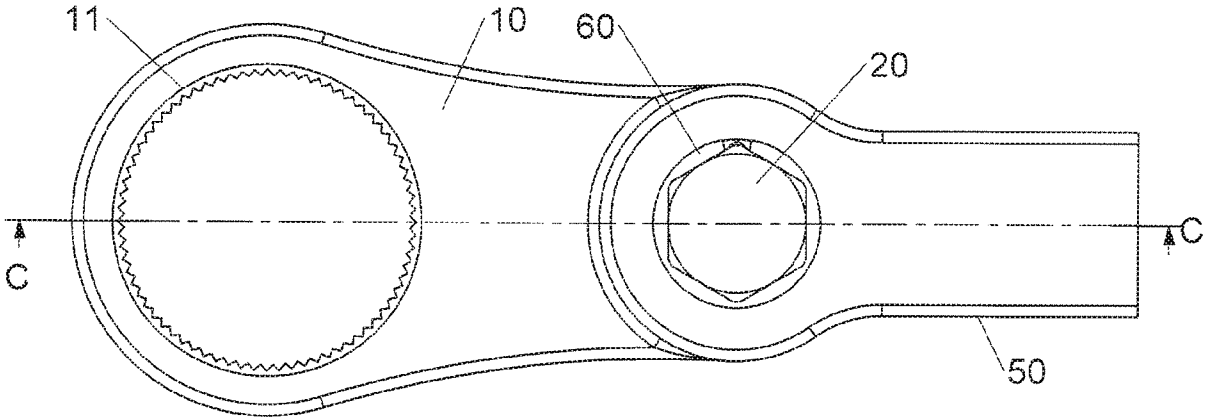
FIG. 6 is a top view the of the hand tool of the present invention.
Figure 7:
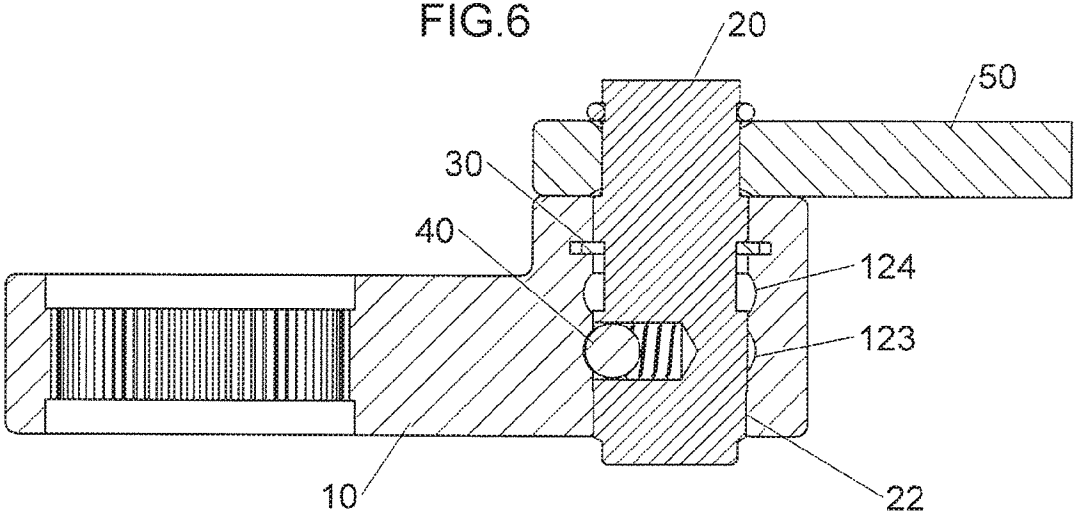
FIG. 7 is a cross sectional view, taken along line C-C in FIG. 6.

As shown in FIGS. 6 and 7, the locking member 20 is inserted in the pivotal hole 121, and the first and second toothed portions 122, 22 are engaged with each other. The restriction member 30 is engaged with the first and second restriction grooves 125, 23. When the restriction member 30 contacts the first contact portion 231, the bead 40 is biased by the resilient member 41 to be engaged with the first groove 123. The third pivotal portion 25 protrudes beyond the first body 10.

Figure 8:
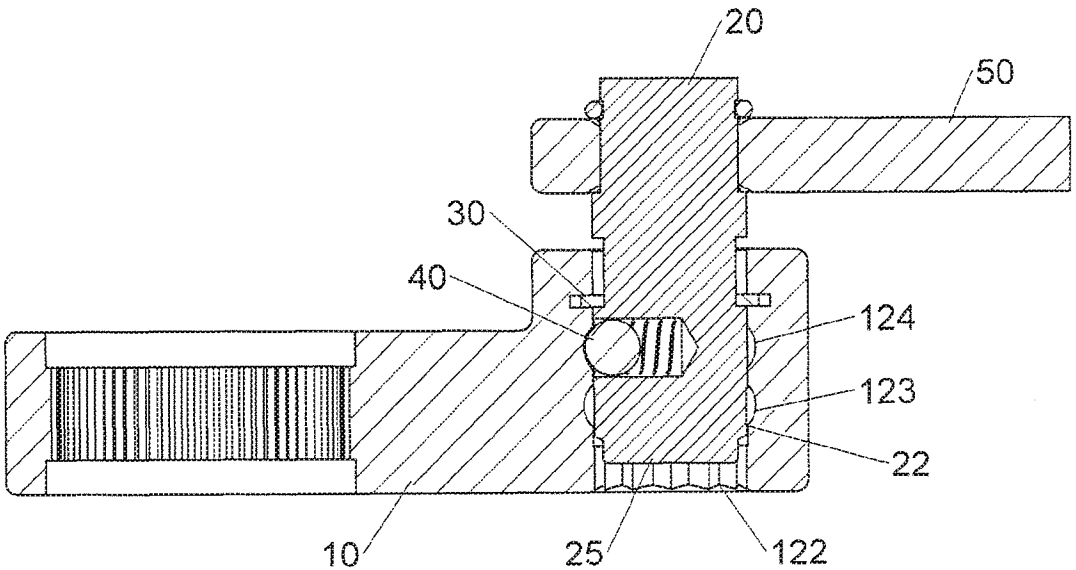
FIG. 8 is a cross sectional view wherein the second body is moved upward.

As shown in FIG. 8, when the user moves the second body 50 upward and drives the locking member 20 to move in the first pivotal portion 12, the restriction member 30 contacts the second contact portion 232, the bead 40 is biased by the resilient member 41 to be engaged with the second groove 124. The first toothed portion 122 is disengaged from the second toothed portion 22, so that the user is able to adjust the angular position of the first body 10 relative to the second body 50.

Figure 9:
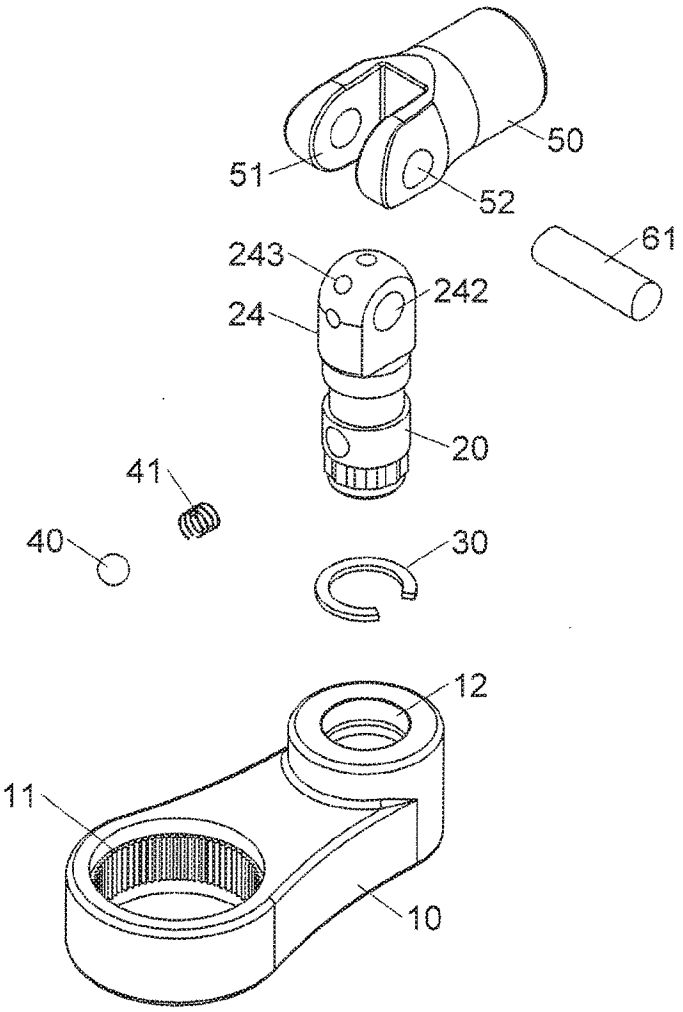
FIG. 9 is an exploded view of the second embodiment of the hand tool of the present invention.
Figure 10:
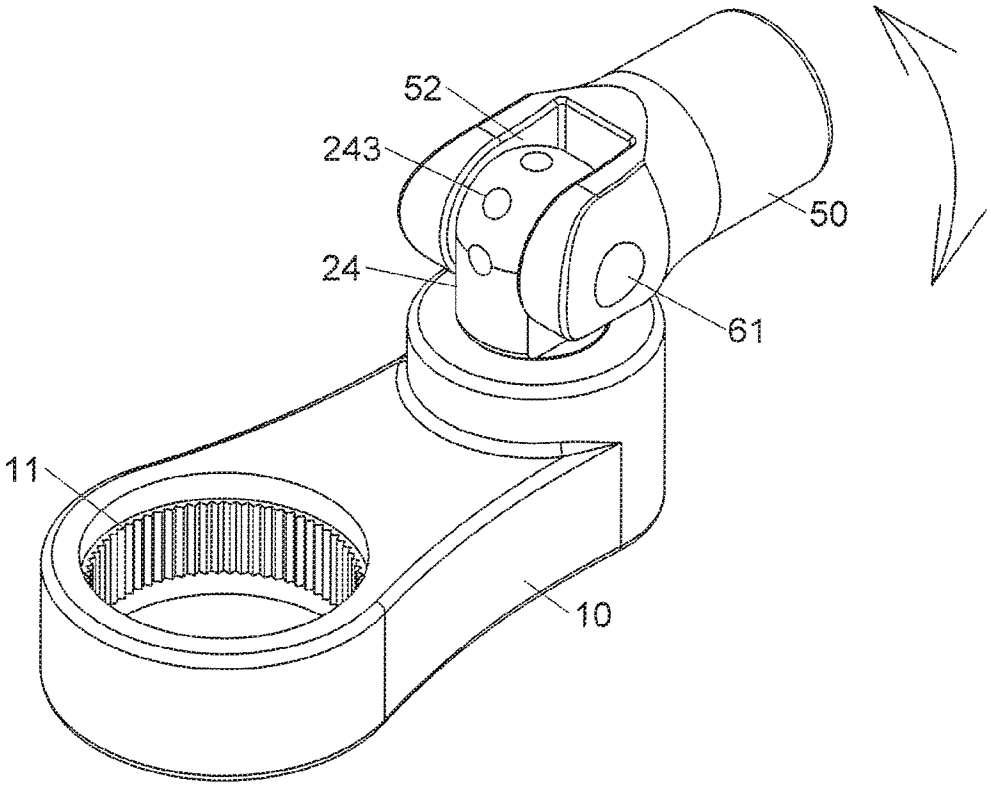
FIG. 10 is a perspective view to show the second embodiment of the hand tool of the present invention.
Figure 11:
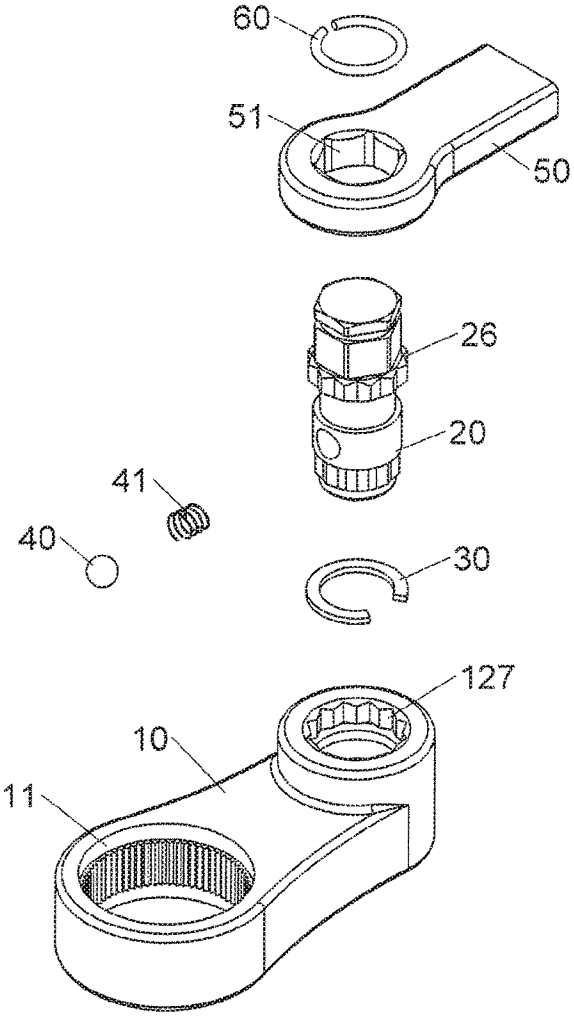
FIG. 11 is an exploded view of the third embodiment of the hand tool of the present invention.
Figure 14:
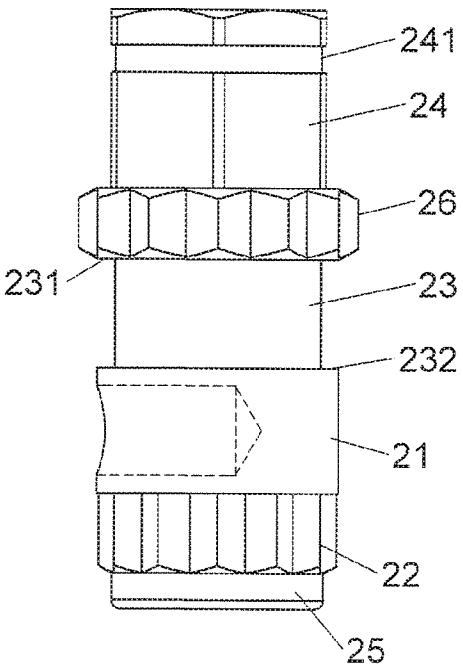
FIG. 14 is a side view to show the locking member in the third embodiment of the present invention.
Figure 12:
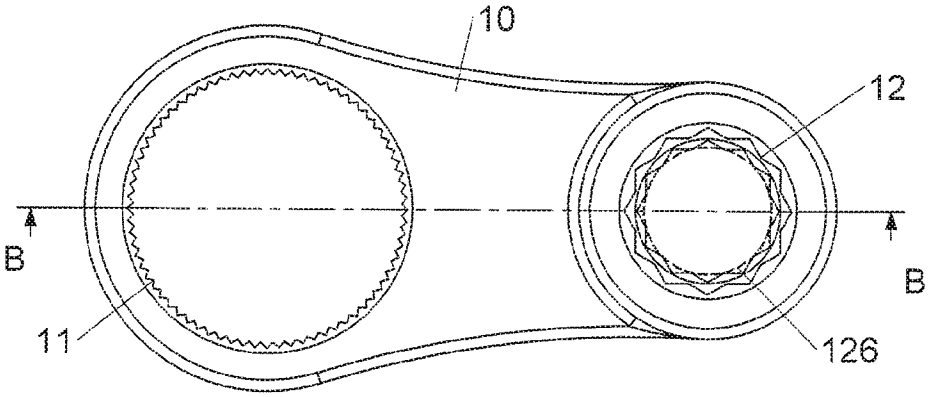
FIG. 12 is a top view of the first body of the third embodiment of the hand tool of the present invention.
Figure 13:
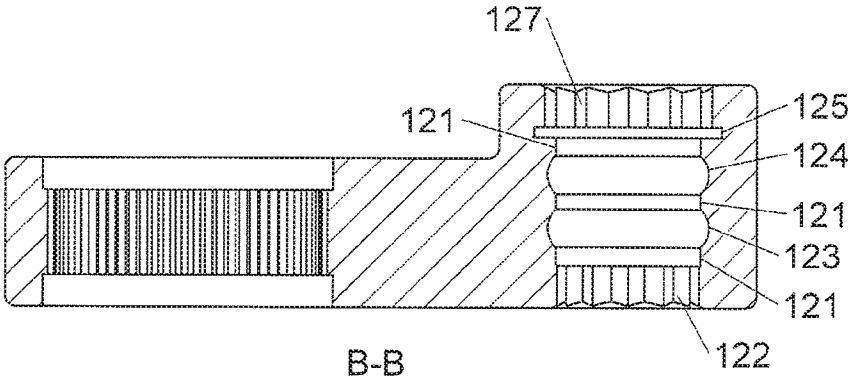
FIG. 13 is a cross sectional view, taken along line B-B in FIG. 12.
Figure 15:
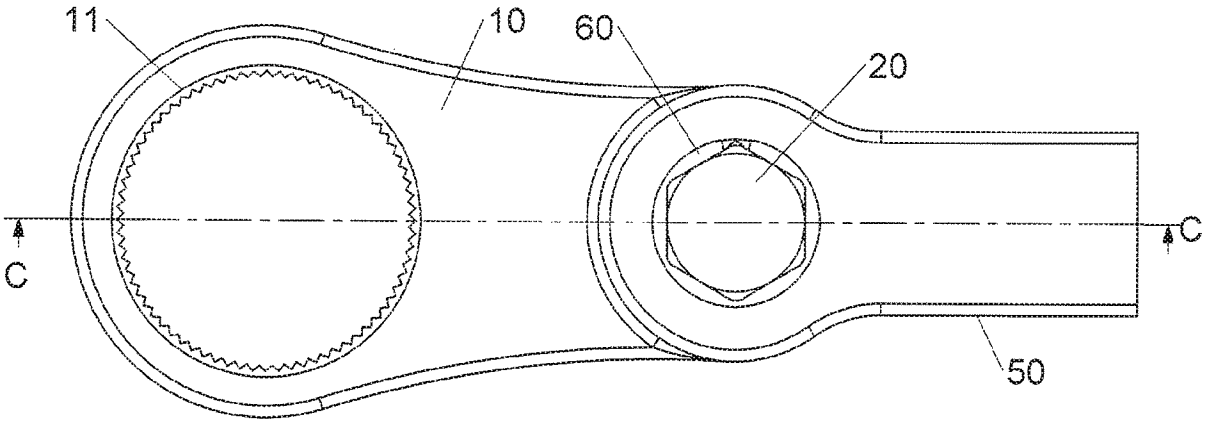
FIG. 15 is a top view of the third embodiment of the hand tool of the present invention.
Figure 16:
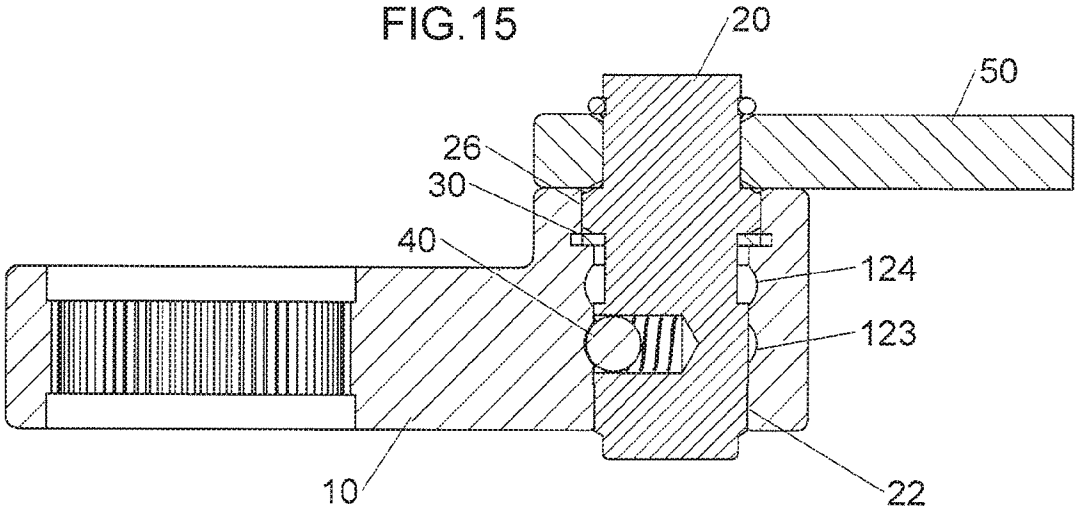
FIG. 16 is a cross sectional view, taken along line C-C in FIG. 15.

As shown in FIGS. 9 and 10, the first connection portion 24 has a first passage 242 defined transversely for pivotally connecting with the second body 50. The first connection portion 24 is a curved portion and has multiple notches 243. The third connection portion 51 has two lugs and each lug has a second passage 52. A pin 61 extends through the second passages 52 and the first passage 242 to pivotably connect locking member 20 with the second body 50. The multiple notches 243 is for engaging with an elastic ball defined on the second body 50 so that the locking member 20 and the second body 50 are positioned at an included angle (ball not shown in the figure).

As shown in FIGS. 11 to 16, a third toothed portion 127 is formed above the first restriction groove 125. The inner diameter of third toothed portion 127 is larger than that of the first toothed portion 122. The locking member 20 has a fourth toothed portion 26 which is located between the second restriction groove 23 and the first connection portion 24 so as to be engaged with the third toothed portion 127.

Yet another embodiment shows that the second connection portion 241 has teeth defined in the outside thereof. The connection member 60 is threadedly connected to the second connection portion 241.

The advantages of the present invention are that when the locking member 20 moves in the pivotal hole 121, the restriction member 30 contacts the first contact portion 231 or the second contact portion 232 to restrict the maximum travel distance of the locking member 20.

When the first and the second toothed portions 122, 22 are engaged with each other, the restriction member 30 contacts the first contact portion 231, and the engaging member 40 is engaged with the first groove 123 so that the hand tool is assembled stably.

When the second body 50 is moved upward to drive the locking member 20, the first and the second toothed portions 122, 22 are disengaged from each other. The user can adjust the angle between the first body 10 and the second body 50.

The third pivotal portion 25 is smaller than or equal to the first diameter 126, when the locking member 20 is pushed downward, the third pivotal portion 25 passes over the first toothed portion 122 so that the first and the second toothed portions 122, 22 are engaged with each other.

When the second body 50 is moved upward, the locking member 20 spins 360 degrees or an angle, the engaging member 40 and the locking member 20 are co-moved. The engaging member 40 is engaged with the second groove 124 and shifts 360 degrees or an angle.

The locking member 20 is pivotably connected to the second body 50, the second body 50 is adjustable relative to the locking member 20.

While we have shown and described the embodiment in accordance with the present invention, it should be clear to those skilled in the art that further embodiments may be made without departing from the scope of the present invention.

What is claimed is:

1. A hand tool comprising:

a first body having a function end and a first pivotal portion, the first pivotal portion having a pivotal hole, a first toothed portion defined in an inside of the pivotal hole and located at a lower portion of the pivotal hole, a first groove and a second groove respectively defined in the inside of the pivotal hole, a first restriction groove defined in the pivotal hole and located above the second groove, a first diameter being defined by tips of teeth of the first toothed portion, the first toothed portion, the second groove and the first restriction groove being located from a top to a bottom of the inside of the pivotal hole;

a locking member extending through the pivotal hole, the locking member having a second toothed portion and a reception hole located at a lower portion of an outside thereof, the locking member having a second restriction groove defined in the outside thereof so as to define a first contact portion and a second contact portion respectively located on two ends of the second groove, the second groove located corresponding to the first restriction groove, a non-circular first connection portion formed on an upper portion of the outside of the locking member, the reception hole located between the second toothed portion and the second restriction groove;

a restriction member being a C-shaped member and engaged between the first and second restriction grooves;

an engaging member and a resilient member located in the reception hole, the engaging member being biased outward by the resilient member;

a second body having a third connection portion so as to be connected to the first connection portion, and when the locking member in the pivotal hole moves to a first position, the restriction member contacts the first contact portion, the engaging member is engaged with the first groove, the first toothed portion is engaged with the second toothed portion, when the locking member in the pivotal hole moves to a second position, the restriction member contacts the second contact portion, the engaging member is engaged with the second groove, the first toothed portion is disengaged from the second toothed portion; wherein a third toothed portion being formed above the first restriction groove, the locking member having a fourth toothed portion, when the first toothed portion is engaged with the second toothed portion, the fourth toothed portion is engaged with the third toothed portion; and wherein a diameter of third toothed portion being larger than that of the first toothed portion.

2. The hand tool as claimed in claim 1, wherein an outer diameter of the function end is larger than that of the first pivotal portion, the function end has teeth formed on an inside thereof.

3. The hand tool as claimed in claim 1, wherein a third pivotal portion extends from an underside of the second toothed portion, a diameter of the third pivotal portion is smaller than that of the second toothed portion, when the restriction member contacts the first contact portion, the third pivotal portion protrudes beyond the first body, a diameter of the third pivotal portion is equal to or smaller than the first diameter.

4. The hand tool as claimed in claim 1, wherein the first connection portion has ridges extending from an outside thereof and the third connection portion has teeth defined in an inside thereof, the second body is a handle.

5. The hand tool as claimed in claim 1, wherein the first connection portion is a hexagonal portion and the third connection portion is a hexagonal recess, the second body is a handle.

6. The hand tool as claimed in claim 1, wherein a second connection portion extends from a distal end of the first connection portion, the second connection portion is a groove, a C-shaped connection member engaged with the second connection portion and engaged with a top of the second body.

7. The hand tool as claimed in claim 1, wherein the first connection portion has a first passage defined transversely, the third connection portion has two lugs and each lug has a second passage, a pin extends through the second passages and the first passage to pivotably connect the locking member with the second body.

8. The hand tool as claimed in claim 7, wherein the first connection portion has multiple notches.

9. The hand tool as claimed in claim 1, wherein a second connection portion extends from a distal end of the first connection portion, the second connection portion has teeth defined in an outside thereof, a connection member is threadedly connected to the second connection portion and is engaged with a top of the second body.

* * * * *